United States Patent [19]

Scharton et al.

[11] Patent Number: 4,905,900

[45] Date of Patent: Mar. 6, 1990

[54] WATER CANNON APPARATUS FOR CLEANING A TUBE BUNDLE HEAT EXCHANGER, BOILER, CONDENSER, OR THE LIKE

[75] Inventors: Terry D. Scharton, Santa Monica; George B. Taylor, Central Valley, both of Calif.

[73] Assignee: Anco Engineers, Inc., Culver City, Calif.

[21] Appl. No.: 211,861

[22] Filed: Jun. 24, 1988

Related U.S. Application Data

[62] Division of Ser. No. 902,470, Aug. 29, 1986, Pat. No. 4,773,357.

[51] Int. Cl.[4] ..... B05B 1/08; B08B 9/00

[52] U.S. Cl. ..... 239/99; 239/390; 239/427.3; 239/432; 239/487; 239/587; 15/316 R; 122/382; 122/392; 122/405; 134/21; 134/22.18; 165/95; 376/316

[58] Field of Search ..... 239/67, 68, 93, 99, 239/101, 427.3, 432, 487, 587, 390; 376/260, 308, 309, 310, 316; 122/382, 390, 392, 397, 405; 261/DIG. 75, DIG. 76; 15/316 A, 316 R; 222/79; 134/166 R, 166 C, 169 R, 169 C, 19, 21, 22.12, 22.18; 165/84, 95

[56] References Cited

U.S. PATENT DOCUMENTS

| | | | |
|---|---|---|---|
| 3,033,278 | 5/1962 | Scarr, Jr. | 239/487 |
| 4,058,256 | 11/1977 | Hobson et al. | 239/101 |
| 4,063,317 | 12/1977 | Santore | 134/166 C |
| 4,492,186 | 1/1985 | Helm | 165/95 |
| 4,645,542 | 2/1987 | Scharton et al. | 376/316 |
| 4,655,846 | 4/1987 | Scharton et al. | 165/95 |
| 4,699,665 | 10/1987 | Scharton et al. | 165/95 |

*Primary Examiner*—Andres Kashnikow
*Assistant Examiner*—Karen B. Merritt
*Attorney, Agent, or Firm*—Thomas I. Rozsa

[57] ABSTRACT

A water cannon, having an air gun disposed within its breach, for explosively discharging a quantity of water from the muzzle, which may include a constricted directional nozzle, to dislodge sludge from the tube sheet of a heat exchanger, and a method of cleaning the tube sheet of a heat exchanger are disclosed.

27 Claims, 6 Drawing Sheets

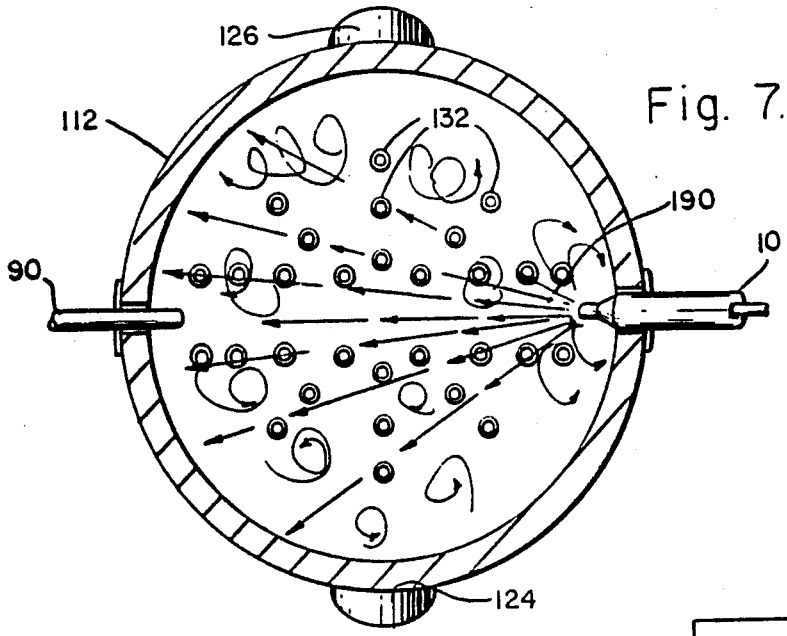
Fig. 7.
Fig. 9.
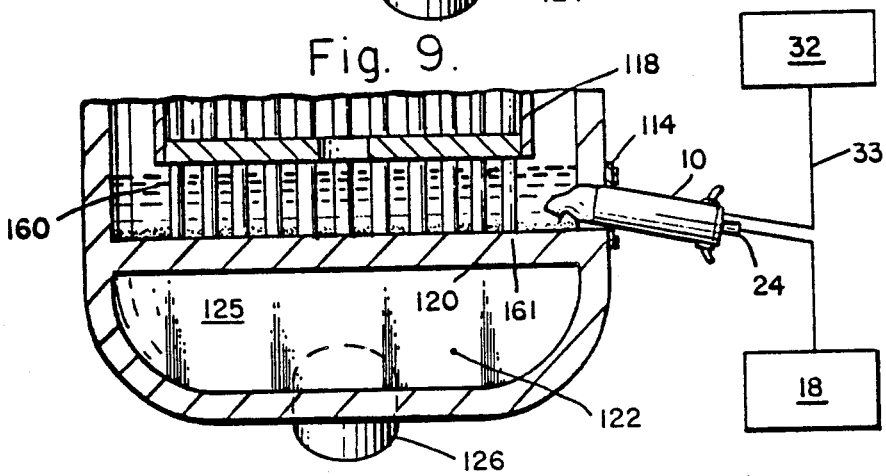
Fig. 8.
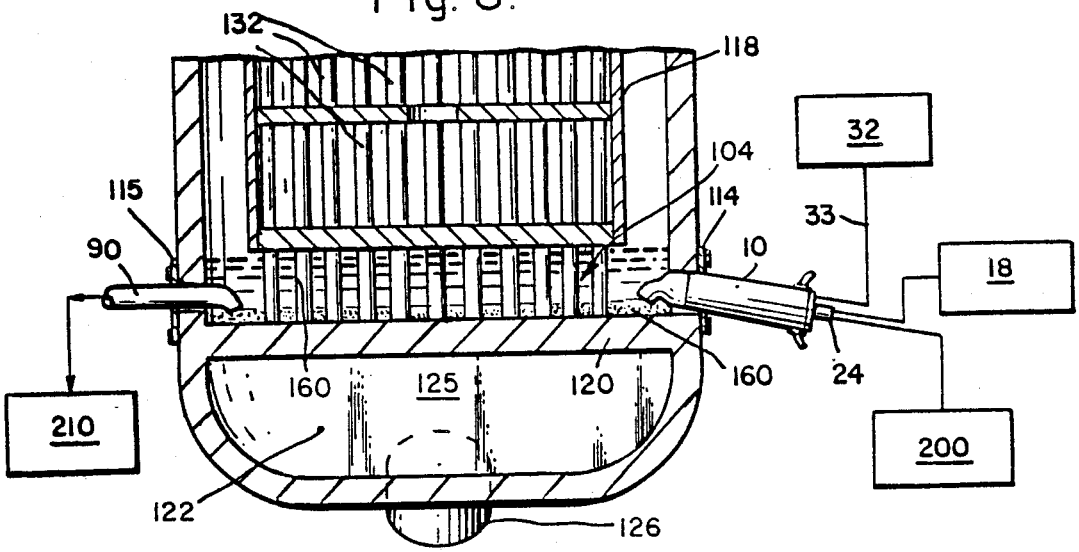

WATER CANNON APPARATUS FOR CLEANING A TUBE BUNDLE HEAT EXCHANGER, BOILER, CONDENSER, OR THE LIKE

This application is a Divisional application of copending application Ser. No. 06/902,470 filed 08/29/86 now U.S. Pat. No. 4,773,357.

BACKGROUND OF THE INVENTION

1. FIELD OF THE INVENTION

The present invention relates to improved hardware for and method of cleaning a tube bundle heat exchanger, such as a steam generator for a nuclear power plant, a boiler, or a condenser. In the embodiment of a tube bundle heat exchanger, which is a steam generator for a nuclear power plant, the method and apparatus are concerned with the removal of sediment or "sludge", which accumulates in the bottom of a heat exchanger vessel, through utilization of a repetitive blast of water directed across the bottom of the heat exchanger. The water blast is generated by a pressurized gas driven water cannon mounted to a hand hole or manway penetration in the heat exchanger shell. The water blasts tend to loosen, suspend and move the sludge so that it may be removed from the heat exchanger by water recirculation and filtering.

2. DESCRIPTION OF THE PRIOR ART

One of the major components in a power generating facility such as a nuclear power plant is the steam generator or heat exchanger portion of the facility. Large scale heat exchanger systems are essentially comprised of a primary system which contains a large number of individual tubes which have fluid circulating through them and a secondary system which consists of a second fluid surrounding said tubes contained within a housing which enwraps both systems. Heat is transferred from the primary fluid running through these heat exchanger tubes to the fluid in the secondary system which is itself eventually turned to steam. The steam, in turn, generates power.

These heat exchangers or steam generators have experienced many problems due to the buildup of products of corrosion, oxidation, sedimentation and comparable chemical reactions within the heat exchanger. The problem of magnetite buildup at the junctions of the primary heat exchanger tubes and the support plates for those tubes, and on the tube sheet at the bottom of the heat exchanger was treated in U.S. Pat. No. 4,320,528. This patent addresses the use of ultrasonic methods to facilitate the removal of the magnetite from those junctions.

At the bottom of the heat exchanger vessel is a tube sheet. The tube sheet is a thick metal plate that supports the numerous heat exchanger tubes, all of which completely penetrate and are sealed by the tube sheet. In addition to the problems of magnetite buildup at the junctions and inside the crevices of the primary heat exchanger tubes and their support plates, a second problem has also troubled heat exchangers such as steam generators for many years. There is a buildup of sedimentation or "sludge" which accumulates in the bottom of heat exchanger vessels. This sludge includes copper oxides, magnetite, and products of corrosion, oxidation, sedimentation and comparable chemical reactions which have not adhered to the tubing or other surfaces and therefore accumulate at the bottom. The sludge pile rests on top of the tube sheet and on top of the higher elevation support plates and may form a thick layer which may become hard and adhere to the structures. The sludge further accumulates in the crevices between the tube sheet and the primary heat exchanger tubes, which are embedded in the tube sheet, and also accumulates on the tube support plates. The problem of removing the sludge which enters the deep crevices in the tube sheet was addressed in presently pending patent application Ser. No. 06/370,826 filed on 4/22/82. U.S. Pat. application 06/370,826 solves the problem of removing sludge from the deep crevices through use of specialized ultrasonic waves which are directed in a certain way to produce the desired result.

In addition to the above two prior art references, the following prior art patents address the problem of cleaning a nuclear steam generator or else keeping it clean before it becomes occluded directly through the use of ultrasonics:

1. U.S. Pat. No. 2,664,274 issued to Worn et al.
2. U.S. Pat. No. 2,987,086 issued to Branson.
3. U.S. Pat. No. 3.033,710 issued to Hightower et al.
4. U.S. Pat. No. 3,240,063 issued to Sasski et al.
5. U.S. Pat. No. 3,295,596 issued to Ostrofsky et al.
6. U.S. Pat. No. 3,433,669 issued to Kouril.
7. U.S. Pat. No. 3,428,811 issued to Harriman et al.
8. U.S. Pat. No. 3,447,965 issued to Teumax et al.
9. U.S. Pat. No. 3,854,996 issued to Frost et al.
10. U.S. Pat. No. 4,120,699 issued to Kennedy et al.
11. U.S. Pat. No. 4,167,424 issued to Jubenville et al.

All of the above referenced patents have been extensively discussed in both U.S. Pat. No. 4,320,528 or else in presently pending patent application Ser. No. 06/370,826 filed on 4/22/82. The following three prior art publications have also been discussed in these references:

1. Chemical Cleaning of BWR and Steam Water system at Dresden Nuc. Pw. Station, Obrecht et al., pp 1–18, (10/26/60) 21st Ann. Conf. of Eng.
2. Special Tech. Pub. 42 (1962) ASTM Role of Cavitation in Sonic Energy Cleaning, by Bulat.
3. R & D Status Report Nuclear Power Division, which appeared on pages 52 through 54 of the April 1981 issue of the EPRI Journal. The Article was by John J. Taylor.

All of the prior art discussed above employs the use of ultrasonics. While the methods discussed in the prior art, especially those in U.S. Pat. No. 4,320,528 and application 6/370 826, are very effective and valuable, the requirement of using ultrasonics has several significant disadvantages. First, expensive transducers must be used to generate the ultrasonic waves. This requires considerable effort and expense to bring the ultrasonic transducers to the site of the steam generator and then putting them in their proper place at the location of the steam generator.

A second problem which arises with prior art applications is the use of corrosive chemicals to assist in the cleaning operation. While the chemicals remove the sludge, they also eat away at the various components of the steam generator. Therefore, it is desirable to find a method of cleaning which does not require the use of corrosive chemicals.

A second method known in the prior art for removing tube sheet sludge is called water lancing. This is in effect the use of a small steady high pressure jet of water which is shot into the sludge pile to dislodge the sludge. The method of this technique is very similar to the common user-operated car wash, having a wand with a nozzle for spraying a stream of water at the location to be cleaned. There are some problems with the water lancing process. The water lance has proven fairly effective for cutting through hard sludge but not very effective for removing the loosened sludge from the interior of the tube bundle. The inability of the water lance to remove sludge stems from the fact that the water lance jet is small, typically one tenth (1/10th) to onehundred (1/100th) of an inch in diameter and the flow rates are small, typically ten (10) to one hundred (100) gallons per minute. In addition, the material loosened moves to the side of the water jet rather than being swept along with it. In addition, it is difficult for a small water jet to penetrate to the interior of the tube bundle. Also, the high pressure jet of water may damage the tubes. The heat exchanger must be completely drained for water lancing to be effective. The small steady high pressure jet of water may cause sludge particles to fly off and then onto the heat exchanger tubes, thereby possibly resulting in damage to these tubes.

The present invention provides a means of achieving a very large diameter and high flow rate blast of water to clean the tube sheet. In addition, the present invention may be used with the heat exchanger partially filled with water.

Water lancing is addressed in greater detail in U.S. Pat. No. 4,407,236 issued to Schukei and U.S. Pat. No. 4,492,186 issued to Helm.

A third method of cleaning heat exchangers is pressure pulse cleaning of tube bundle heat exchangers. Three presently pending patent applications by inventors Scharton and Taylor relating to different aspects and methods of pressure pulse cleaning are as follows:

1. Application Ser. No. 06/742,134 now U.S. Pat. No. 4,655,846 entitled "Method Of Pressure Pulse Cleaning A Tube Bundle Heat Exchanger".
2. Application Ser. No. 06/604,048 now U.S. Pat. No. 4,645,542 entitled "Method Of Pressure Pulse Cleaning The Interior Of Heat Exchanger Tubes Located Within A Pressure Vessel Such As A Tube Bundle Heat Exchanger, Boiler, Condenser Or The Like".
3. Application Ser. No. 06/686,242 now U.S. Pat. No. 4,699,665 entitled "Method of Pressure Pulse Cleaning Heat Exchanger Tubes, Upper Tube Support Plates, And Other Areas In A Nuclear Steam Generator And Other Tube Bundle Heat Exchangers."

These three pending applications are mentioned to provide background into the state of the art. They are not incorporated by reference.

The pressure pulser works by blasting a volume of pressurized gas into a heat exchanger partially filled with water. The blast is introduced either through a hand hole or directly from a fast opening valve immersed in the generator. The expanding gas bubble rapidly displaces the water and the shock wave from the gas blast plus the rapid water motion provides the cleaning effect.

While pressure pulse cleaning is a field-proven technique for cleaning heat exchanger support plates, it has not yet been successful for cleaning tube sheets because the pulse is non-directional. The present invention provides a means of efficiently converting the energy of the pressurized gas into water motion and of directing the water motion toward and across the heat exchanger tube sheet.

Therefore, although the use of ultrasonics combined with chemicals, the use of a jet of water, and the use of pressure pulses are all known in the prior art for cleaning and removing sludge at the bottom of a heat exchanger or steam generator, none of these methods can be employed without the significant problems discussed above. At present, there has been no prior art method for effectively removing the tube sheet sludge through a very quick, inexpensive method which does not require the use of chemicals.

SUMMARY OF THE PRESENT INVENTION

The present invention relates to a method and apparatus for effectively and efficiently removing copper oxides, magnetite and other products of corrosion, oxidation, sedimentation and comparable chemical reactions collectively referred to as a sludge pile which settle on the tube support sheet of a tube bundle heat exchanger through the generation of a blast of high velocity and high mass flow-rate stream of water impacting directly onto the tube sheet, causing the pile of sludge to be physically moved to a location adjacent the heat exchanger wall, from which it can be removed through a vacuuming and suction system.

It has been discovered, according to the present invention, that if a high velocity high mass flow rate stream of water is caused to be fired at the tube sheet repeatedly, then the pile of sludge will be moved from all locations on the tube sheet and will accumulate adjacent to the wall of the heat exchanger where the sludge can be removed through a suction and vacuuming process.

Since heat exchangers usually contain at least one lateral opening within a reasonable distance of the tube sheet (such as a hand hole located approximately twenty inches above the tube sheet), it has been discovered that the placement of the present invention water cannon through such a hand hole provides a suitable location from which the source of high velocity high mass flow rate water can be directed at the pile of sludge.

It has also been discovered according to the present invention that if a cylindrical apparatus is used, which may be described as a gun, contains a source of pressurized gas such as an air gun located in its breech for generating a powerful blast of gas into the barrel, and the barrel is filled with water immediately prior to detonation, then the water in the barrel will be shot out of the muzzle end of the apparatus with sufficient velocity and volume to create a water cannon effect. It has additionally been discovered that if the muzzle of the water cannon has a nozzle attached to it the direction of the expelled water can be controlled.

It has also been discovered that, according to the present invention, the air gun, which creates the explosive blast of gas, may be conveniently located inside the barrel of the water cannon, which couples the force of the expanding gas with the load of water very efficiently. Alternatively, the air gun may be located outside the barrel, and connected thereto by a pipe through which the expanding gas rushes into the barrel. This arrangement results in a water cannon having a barrel that weighs less, and so is more easily installed, and otherwise controlled.

It has additionally been discovered, according to the present invention, that the addition of several mechanical enhancements can provide for a more effective system. For example:

1. An extension member can be added to the nozzle to cause the output end to come down adjacent the pile of sludge for more action against the pile of sludge.

2. The barrel of the water cannon may include one or more deflector members to direct gas exiting the valve ports of the pressurized gas valve assembly down the barrel and toward the water in the barrel waiting to be impacted.

3. The nozzle may further incorporate swirl vanes, which cause the water to swirl as it is shot out of the barrel.

4. The top of the nozzle may contain at least one vent hole to assist in removing the expended gas from the barrel before the next firing.

5. The nozzle may include articulation means to more accurately direct the flow of water being fired out of the water cannon.

6. The barrel wall may contain mixing vanes to cause the fired gas to mix more efficiently with the water it impacts and prevent the gas from hugging the side wall of the barrel and exiting directly out the nozzle.

7. The barrel may include a plenum for storing greater quantities of gas before the water cannon is fired, thereby increasing the impact of the pressure on the water in the barrel.

It has also been discovered, according to the present invention, that several different water addition and removal systems are operable with the water cannon in its simplest form or with one or more embellishments added. For example:

1. Recirculation System. Water can be recirculated into the heat exchanger through the water cannon nozzle and out of the heat exchanger through a suction nozzle located in the same hand-hole as the water cannon, another hand-hole, or another secondary side access port. A pump circulates the water through a filtering system where the sludge and other debris are removed from the water before it is recirculated back through the water cannon.

2. Open Loop System. A source of fresh water from a water tap can be used to fill the barrel with water after each firing and a vacuuming system or draining of the heat exchanger can be used to remove the dirty water and entrained sludge from the heat exchanger.

3. Gravity Fill System. The water cannon can be refilled with water from the heat exchanger after each firing if the water level in the heat exchanger is higher than the muzzle of the water cannon and the muzzle is higher than the breech of the water cannon.

It has also been discovered that the method of repeatedly firing the water cannon with a high velocity high mass flow stream of water in the heat exchanger such that the water is directed onto the area to be cleaned provides a very effective method of cleaning the heat exchanger and in particular in cleaning the sludge which rests on top of the tube support sheet.

It has also been discovered that the water cannon is exceptionally effective in cleaning any hard durable surface, such as removing paint or other stains from pavement or exterior walls.

It is therefore an object of the present invention to provide a method and apparatus for effectively and efficiently removing deposits of copper oxides, magnetite, and other products of corrosion, oxidation, sedimentation and comparable chemical reactions (collectively referred to as a sludge pile), which settle on the tube support sheet of a tube bundle heat exchanger through the generation of a blast of high velocity and high mass flow-rate stream of water impacting directly onto the tube sheet causing the pile of sludge to be physically moved to a location adjacent the heat exchanger wall from which it can be removed through a vacuuming and suction system.

It is also an object of the present invention to provide optional features to the apparatus to more efficiently permit the pressure force such as pressurized gas to impact the water to create a more effective blast, and to more efficiently direct the flow of the blast onto the area to be cleaned.

It is a further object of the present invention to provide a method and apparatus which can also clean upper tube support plates as well as the lowermost tube sheet.

It is additionally an object of the present invention to provide alternative ways to fill the apparatus with water before each firing and alternative ways to remove the dirty water from the heat exchanger and either have it flushed or else filtered and returned to the apparatus for a subsequent firing.

It is a further object of the present invention to provide a method and apparatus for cleaning any object which may be cleaned by subjecting it to the action of the water blast emanating from a water cannon.

Further novel features and other objects of the present invention will become apparent from the following detailed description, discussion and the appended claims taken in conjunction with the drawings.

DRAWING SUMMARY

Referring to the drawings for the purpose of illustration only and not limitation there is illustrated:

FIG. 7 is a sectional view of the steam generator taken along lines 2—2 of FIG. 1, that is, basically a plan view of the upper surface of the tube sheet, showing the sludge pile movement and ring vortices created by the blast from the water cannon.

FIG. 8 is a fragmentary sectional elevation of a heat exchanger, with one embodiment of the present invention water cannon inserted through an opening in the heat exchanger wall, disclosing one alternative vacuuming and water replenishment system used in conjunction with the water cannon, in an open loop system.

FIG. 9 is a partial side elevational view of a heat exchanger with one embodiment of the present invention water cannon inserted through an opening in the heat exchanger wall and disclosing a second alternative water removal and gravity fill water replenishment system used in conjunction with the water cannon.

DETAILED DESCRIPTION OF THE PREFERRED EMBODIMENT

The apparatus and method of the present invention are used in conjunction with tube bundle heat exchangers, boilers, condensers or the like, or any other object which may be cleaned by the action of the water cannon. One type of tube bundle heat exchanger in which the apparatus and method of the present invention are used is a nuclear steam generator. Nuclear steam generators are conventionally formed in two primary designs: (1) a U-bend tube steam generator in which the heat exchanger tubes are generally "U" shaped so that the inlet and exit nozzles of the heat exchanger tubes are located at the same end of the heat exchanger and (2) a straight-line tube or once-through steam generator in which the heat exchanger tubes are not bent so that the inlet nozzle is at one end of the steam generator and the exit nozzle is at the opposite end of the steam generator. For purposes of the discussion in this patent application, the present invention will be used in conjunction with a U-bend type steam generator. However, it is emphasized that the present invention can also be used with once-through steam generators, and other heat exchangers, boilers, condensers or the like.

Figure 1:
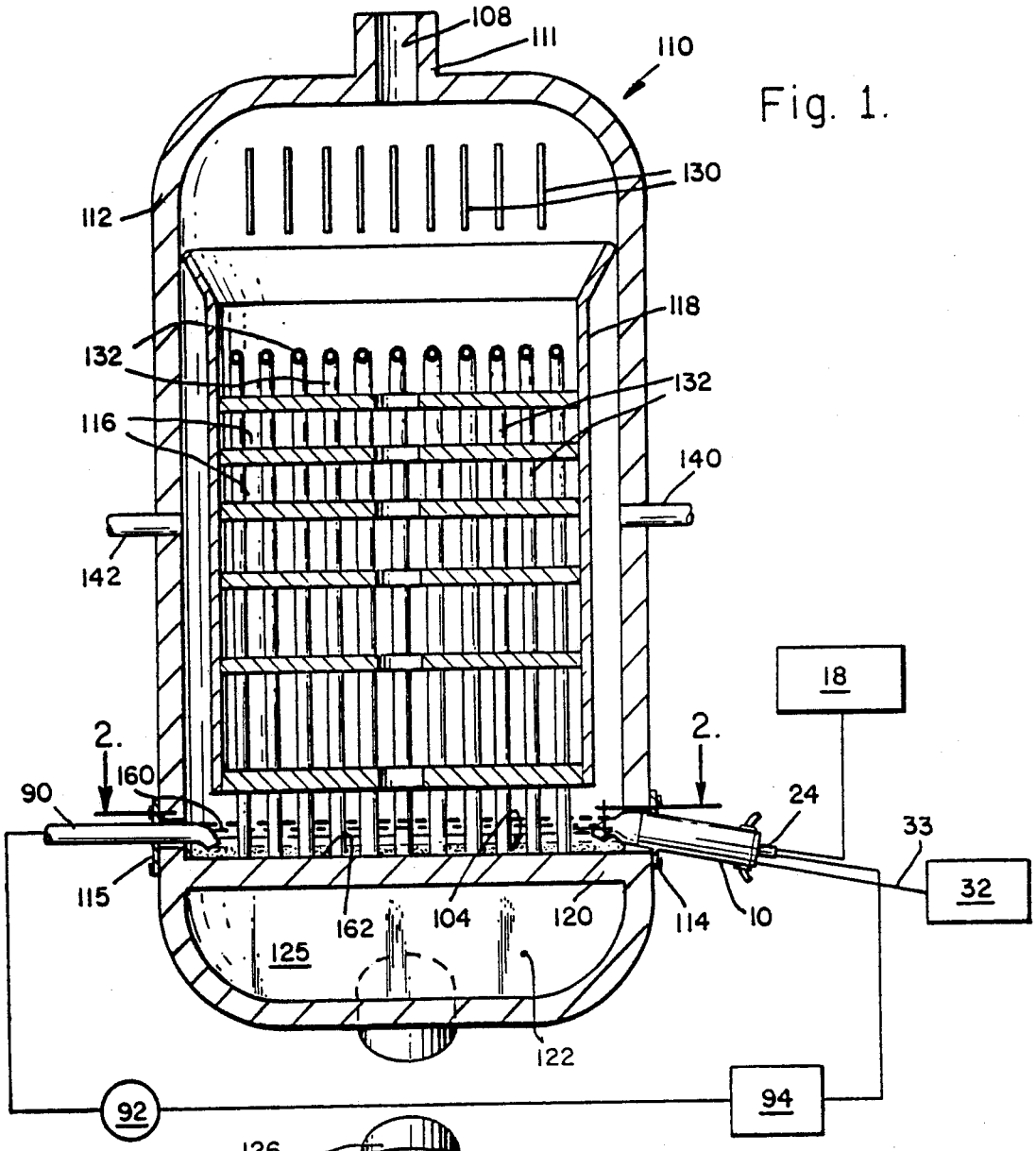
FIG. 1 is a side elevation, partially in section, of a U-Bend type heat exchanger which is a steam generator, with the tube lane parallel to the direction of the section cut, and the present invention water cannon inserted through an opening in the heat exchanger wall and a vacuum, filtering and recirculation system shown in block diagram form.

FIG. 1 is a side sectional view of a typical U-bend steam generator with the section cut parallel to the tube lane between the U-bend of the heat exchanger tubes. The steam generator is shown at 110. The external shell or envelope 112 of said steam generator 110 is a pressure vessel. In this external shell 112 are a large number of heat exchanger tubes 132. At the base of the heat exchanger tubes 132 is the tube support sheet 120. A cylindrical metal wrapper 118 envelops heat exchanger tubes 132 and their tube support plates 116.

Figure 2:
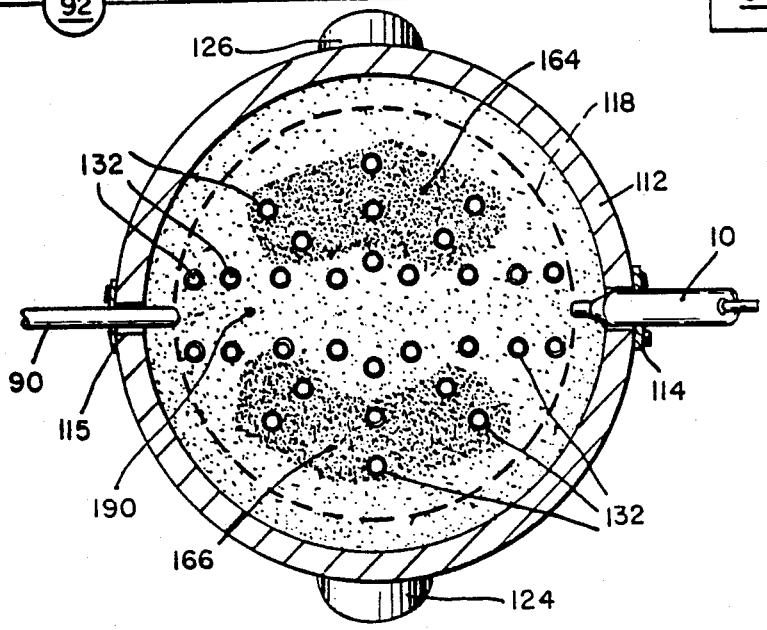
FIG. 2 is a plan view of the tube sheet with a sludge pile thereon and showing a tube lane, with the plan view taken along lines 2—2 of FIG. 1.

Referring to FIGS. 1 and 2, at the base of the steam generator 110 is a primary entrance nozzle 124 (See FIG. 2) which leads to the entrance chamber 125 located directly below the tube sheet 120. On the opposite side of the heat exchanger 110 is the exit chamber (not shown) and the primary exit nozzle 126. The exit chamber is also located directly below the tube sheet 120. The entrance chamber 125 and the exit chamber are separated by a metal wall 122.

Initially, a secondary fluid 104 enters the heat exchanger or steam generator 110 through secondary entrance inlets 142 and 140 respectively located in the external shell 112. The secondary fluid 104 fills the steam generator 110 and surrounds the heat exchanger tubes 132.

In normal operation, the primary fluid 102 comes from a heat source such as a nuclear reactor and enters said steam generator 110 through the primary entrance nozzle 124. The fluid enters into the entrance chamber 125 and is forced through the heat exchanger tubes 132 and up through the steam generator or heat exchanger 110. The heat exchanger 110 illustrated in FIG. 1 is of the U-bend type, where the primary heat exchanger tubes 132 run most of the length of the steam generator 110 and are bent at the top to form a U-shaped configuration. Upon reaching the uppermost portion of the primary heat exchanger tubes 132, the primary fluid 102 starts back down the opposite side of the primary heat exchanger tubes 132, goes into the exit chamber and exits the heat exchanger 110 through primary outlet nozzle 126.

Often one or more rows of tubes are missing from the center of the U-bend region of the tube bundle, thereby forming tube lane 190 (as shown in FIG. 2) of one or more tube widths. Typically, there is only one tube lane, and it runs across a diameter of the tube sheet. Hand hole 114 is often located at one end of the tube lane 190. A second hand hole 115 may be located at the opposite end of the tube lane 190.

Heat which is carried by the primary fluid 102 is transferred to the secondary fluid 104 while the primary fluid 102 is circulating through heat exchanger tubes 132. Sufficient heat is transferred to the secondary fluid 104 so that the primary fluid 102 leaving the exit nozzle 126 is at a substantially lower temperature than it was when it entered the steam generator through entrance nozzle 124. The secondary fluid 104 absorbs heat carried by the primary fluid 102 and said secondary fluid 104 becomes steam 108 during the heat absorption process. Steam 108 passes through separators 130 which remove excess moisture from said steam 108, and then exits through steam outlet 111 at the top of the steam generator 110. The high pressure steam 108 can then be used to drive a turbine.

The primary fluid 102 can be water. A gas such as helium, or another liquid such as liquid sodium can also be used for the primary fluid. The secondary fluid is usually water.

During the process described above, a large amount of moisture and heat are generated within the steam generator 110. This leads to corrosion of various portions of the steam generator 110. Some of the corrosion remains on the metal, especially at the juncture of the primary heat exchanger tubes 132 and their support plates 116. Much of the products of corrosion, oxidation, sedimentation and comparable chemical reactions do not remain on the metal heat exchanger tubes 132 or their support plates 116 but instead settle at the bottom of the steam generator 110 and on top of the tube sheet 120. The buildup of the products of corrosion, oxidation, sedimentation and comparable chemical reactions may contain elements such as magnetite, chlorides, copper oxides, etc. and will in general be cumulatively referred to as sludge 160. The pile of sludge 160 settles on the tube sheet 120 and in between the very closely spaced heat exchanger tubes 132.

FIGS. 1 and 2 show the sludge pile 160 which rests on the tube sheet 120 and surrounds the exposed lower portion of the primary heat exchanger tubes 132. Sludge 162 on the tube sheet 120 concentrates harmful chemicals around heat exchanger tubes 132, which attack heat exchanger tubes 132 in a variety of ways, which have caused a variety of very costly corrosion problems (See Hightower, U.S. Pat. No. 3,033,710, which is hereby incorporated by reference). Consequently most electric power utilities make every effort to remove this sludge pile 160 from their steam generators every year when the plants are shut down for refueling.

It is difficult to remove the sludge 162 since it accumulates between closely spaced heat exchanger tubes 132. While the sludge 162 can accumulate throughout the entire tube sheet area as shown in FIG. 2, the sludge typically concentrates in two generally kidney shaped areas outlined as 164 and 166, respectively, in FIG. 2 which are located toward the central portion of the tube sheet 120. Since these areas are frequently well within many rows of heat exchanger tubes 132, they are difficult to reach and accordingly the sludge therein is difficult to remove.

The apparatus and method of the present invention provide a novel way of removing the sludge 162 which accumulates in the sludge pile 160 on the top of the tube sheet 120 and is especially effective for reaching the hard to get at kidney shaped areas 164 and 166.

Figure 3:
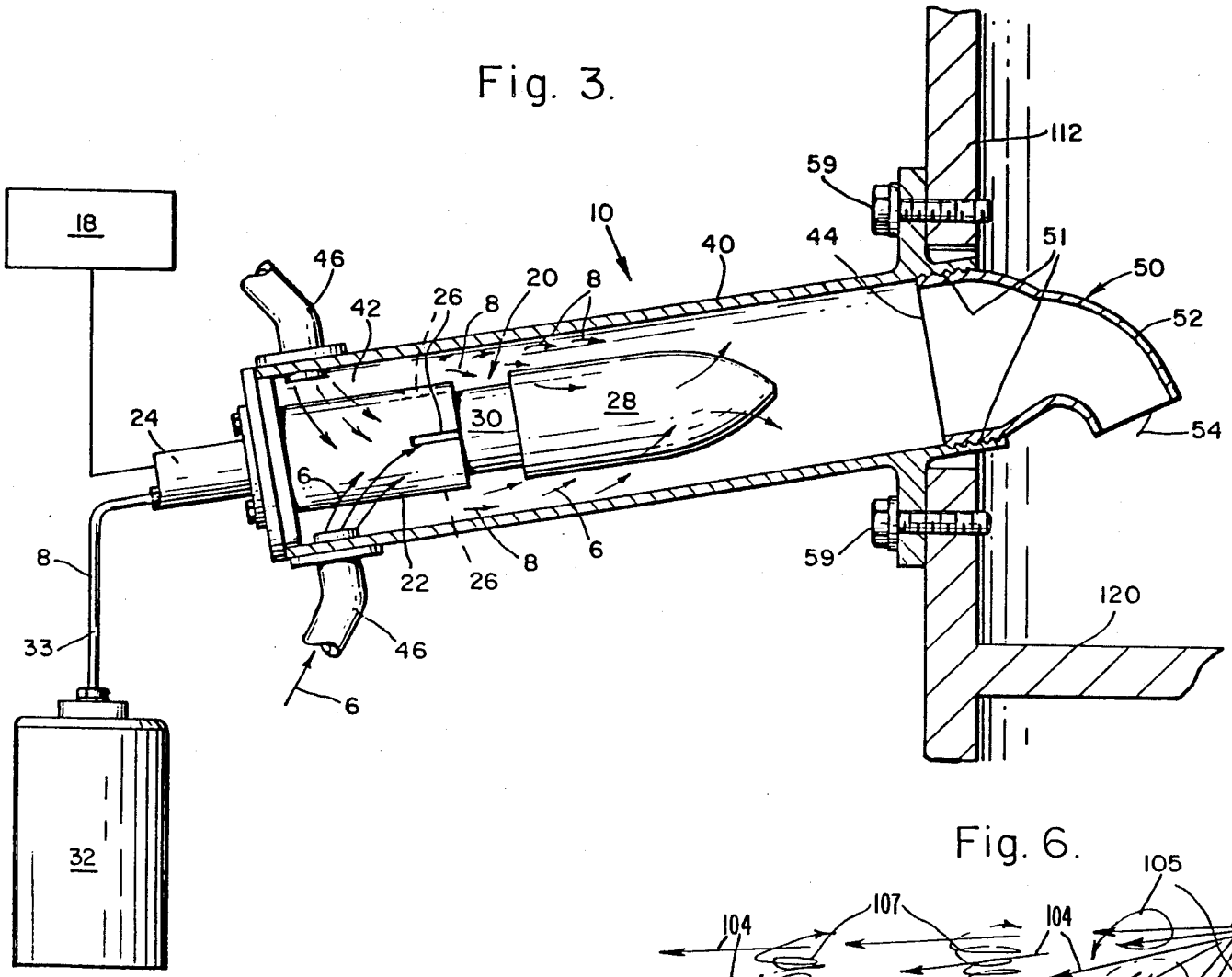
FIG. 3 is an elevation, partially in section, of one embodiment of a water cannon inserted into a penetration in a heat exchanger, with a gas source, solenoid and electronic circuitry shown in block diagram form.

The key portion of the apparatus of the present invention comprises an apparatus for generating a blast of high velocity and high mass flow-rate stream of water for dislodging, suspending and moving sludge 162 from the tube bundle heat exchanger or steam generator tube sheet 120. The preferred embodiment of the present invention water cannon Apparatus 10 is shown in FIG. 3. The water cannon Apparatus consists of three principal components: (1) a pressurized gas valve assembly which energizes the cannon; (2) a water barrel through which water flows into the heat exchanger; and (3) a nozzle for increasing the velocity of the water and directing the flow.

The principal components and their subcomponents of the water cannon Apparatus 10 will now be described in detail. Referring to FIG. 3, air gun 20 includes a pressurized gas valve assembly, which must be capable of opening and closing quickly to release a charge of pressurized gas into the rear or breech portion 42 of the water cannon Apparatus 10. Air gun 20 comprises a pressurized gas valve 22 which is opened directly by a solenoid 24 or by a solenoid operated pilot valve 24. The pressurized gas valve 22 includes four ports 26 through which gas exits from the valve assembly 20. The exact number of ports is not important, and in fact in the preferred embodiment illustrated in FIG. 10 may be one port, as is described below in the discussion of FIG. 10. In the preferred embodiment having four ports, each port 26 consists of a recessed rectangular portion having an opening controlled by a normally closed valve that opens very quickly in response to the firing command from the solenoid. The pressurized gas valve assembly 20 further comprises a gas accumulation chamber 28 connected to the pressurized gas valve 22 by interconnecting means such as cylinder 30. As shown in the preferred embodiment in FIG. 3, air gun 20 (except for the solenoid 24 and ancillary apparatus, such as the pressurized gas bottle) is secured inside barrel 40 of the water cannon 10. A source of pressurized gas, that is, gas source 32, is then connected to the pressurized gas valve 22 through gas tubing or supply line 33.

In operation, gas 8 from the gas source 32 is forced under pressure through the gas tubing 33 and into the pressurized gas valve 22. Gas is permitted to accumulate in gas accumulation chamber 28 until the entire amount of gas desired for a firing has been accumulated.

The solenoid 24 is connected to an electrical firing circuit means 18, comprised of conventional electronics, which triggers the solenoid, which in turn quickly opens pressurized gas valve 22 to cause the gas 8 to be fired through ports 26 in the pressurized gas valve 22.

In general, the pressurized gas valve 22 must be supplied with a source of pressurized gas (which can be any pressurized gas but is usually nitrogen, which is essentially inert under the conditions encountered in the use described). Release of pressurized gas through ports 26 is controlled by solenoid operated pilot valve 24, and electric trigger circuitry 18. A gas accumulation chamber or gas plenum 28 stores a fixed volume of pressurized gas 8 immediately adjacent to the valve to increase the power that can be transferred to the water in barrel 40.

Pressurized gas valve 22 should be capable of rapid repetitive operation and should also be capable of repetitive firings at a rapid rate. The cycle time between consecutive firings is determined primarily by the time it takes to recharge gas accumulation chamber 28 and the time it takes for the gas from the last firing to be exhausted from the barrel 40 of the water cannon 10 (as will be described). In some configurations, the gas accumulation chamber 28 may be located outside of the barrel 40 of the water cannon 10 or may be eliminated if the gas supply line 33 to the source of pressurized gas 32 is sufficiently large to allow large flow rates of gas.

Air guns suitable for use with the water cannon of the present invention are well known in the art. One type of air gun, which can use air or nitrogen, is a PAR AIR GUN manufactured by Bolt Technologies Corp., of Norwalk, Conn. One specific model that can be used is the Model 600B PAR AIR GUN. This Bolt PAR AIR GUN can incorporate a pulse shaping feature in the gas accumulation chamber or plenum which allows the pulse duration and strength to be adjusted. Pulse shaping is achieved through use of a small secondary chamber which includes a plurality of mating parts within the large plenum. The size of the secondary chamber and the size of ports connecting the primary and secondary chamber (not shown) control the initial and secondary flow rate of gas from the pressurized gas valve 22.

The second major component of the water cannon 10 is the barrel 40. The barrel 40 of the water cannon 10 is designed to convert the pressurized gas energy into water flow in the most efficient manner. The breech or rear end 42 of the barrel 40 is connected to the pressurized gas valve assembly or air gun 20 and muzzle 44 is connected to heat exchanger 110 and a nozzle 50 which protrudes through a penetration such as a hand hole 114 or manway into the heat exchanger wall 112 (as will be described). The barrel 40 also includes means for refilling the barrel 40 with water 6 after the pressurized gas valve 22 is fired. It is preferable to exhaust most or all of the gas 8 from the barrel 40 after firing so that barrel 40 is completely filled with water before water cannon 10 is fired.

The barrel 40 may be continuously filled with water 6 via one or more water inlets 46 at the breech 42 of the water cannon 10 (FIG. 3), which exhausts all the gas 8 from the barrel 40 after the pressurized gas valve 22 is fired through muzzle 44, when muzzle 44 is higher than breech 42. Also, the replenishment water 6 provides a continuous stream of water 6 out of the nozzle 50 of the water cannon 10, thereby serving as the water inlet portion of a recirculation system for the heat exchanger cleaning (as will be described).

A third primary component of the water cannon 10 is the nozzle 50. Nozzle 50 increases the velocity of the water 6 exiting through it, and deflects the water stream down onto the tube sheet 120. Nozzle 50 incorporates a converging section 52 which converts the high pressure in the water cannon barrel 40 to high exit velocity from the nozzle. Nozzle 50 also increases the back pressure on the pressurized gas valve 22, thereby increasing the efficiency of the transfer of energy from the pressurized gas 8 to the water 6.

The above describes the elements of a preferred embodiment of the water cannon 10. There are several optional features which can be added to enhance the effectiveness of the water cannon 10, which will be described below.

Figure 4:
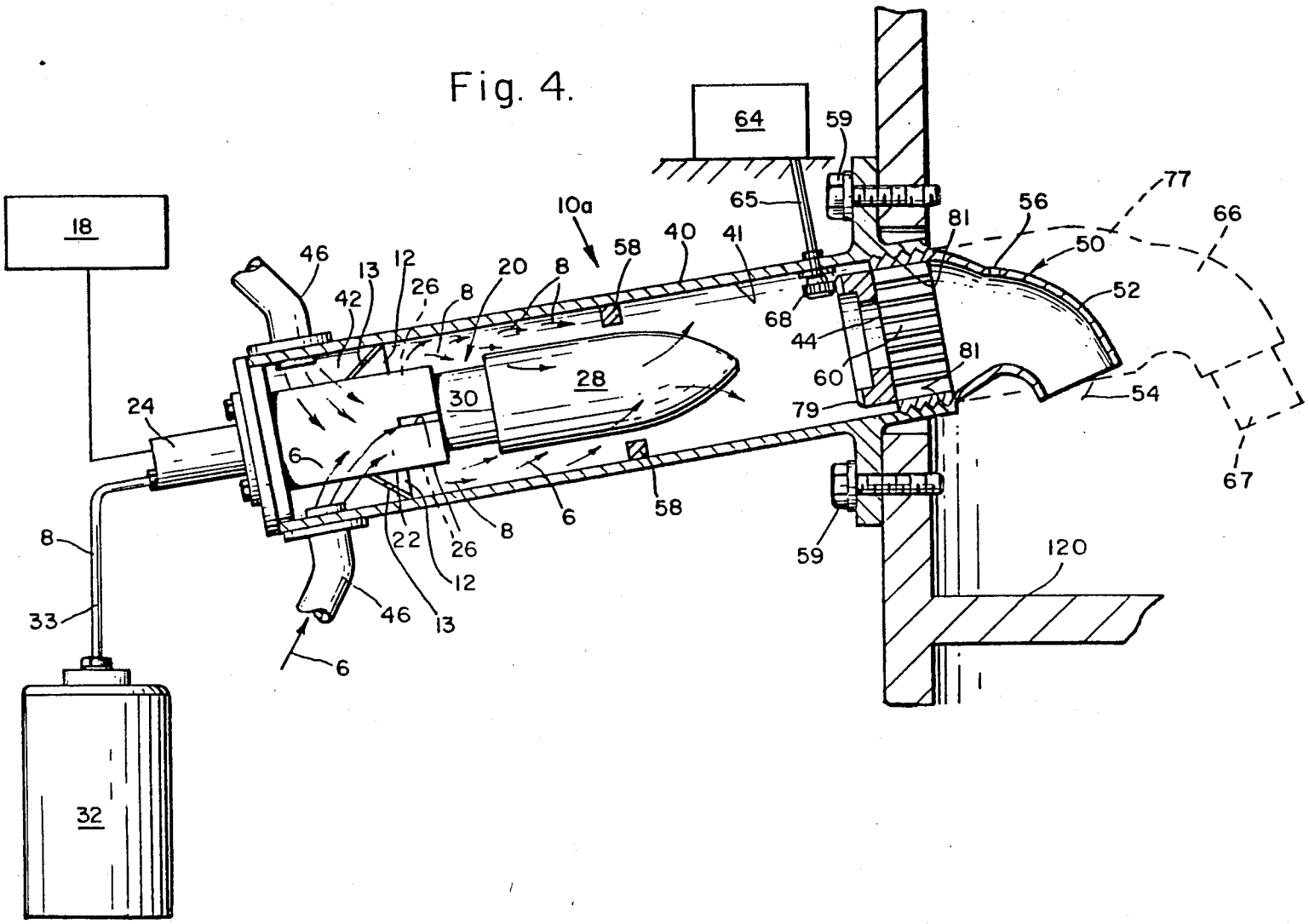
FIG. 4 is an elevation, partially in section, of an alternative embodiment of a water cannon inserted into a hand hole in a heat exchanger, with a gas source, solenoid and electronic circuitry shown in block diagram form.

Referring to FIG. 4, water cannon 10a includes a deflector member 12, associated with each gas valve port 26, to direct the gas 8 exiting the valve ports 26 axially down the barrel 40 of water cannon 10. Deflector members 12 consist of metal plates located adjacent to and behind gas valve ports 26, which are welded to the exterior of barrel 40 and slanted toward muzzle 44, dramatically reducing spread of explosively released gas rearward toward breech 42 and thereby increasing the efficiency of water cannon 10*a*. As illustrated in FIG. 4, deflector member 12 is curved to resemble the curvature of the substantially cylindrical body of air gun 20. Alternatively, deflector members 12 may simply be plates.

Another optional feature illustrated in FIG. 4 consists of slots 13 or other apertures in deflector members 12, which permit water 6 to flow around deflector members 12 and axially down the barrel 40. Slots 13, or other apertures, are large enough that water flows through them readily during loading of water cannon 10*a*. They are small enough, however, to prevent significant flow of water backwards (that is, toward the breech) upon firing because the explosive charge of gas can be depressurized more quickly by forcing water out the muzzle.

Again referring to FIG. 4, barrel 40 may also include one or more mixing vanes 58 disposed along the interior side wall of barrel 40 along a circle perpendicular to the longitudinal axis of said barrel at a point adjacent to plenum 28, to mix the gas 8 with the water 6 and assist in transferring the energy from the gas 8 to the water 6. In addition, mixing vanes 58 prevent gas 8 from hugging the side walls 41 of the barrel 40 and going directly out of the nozzle.

Still referring to FIG. 4, swirl vanes 60 disburse the explosively discharged water after it enters the heat exchanger, and create tornado-like disturbances in the water in the bottom of the heat exchanger. Swirl vanes 60 consist of a plurality of stationary turbine blades that impart a rotating motion to discharged water. Swirl vanes 60 are located at muzzle 44 and may conveniently be disposed throughout the area of the muzzle cross section. Swirl vanes 60 may be employed with or without nozzle 50.

Nozzle 50 may be an integral portion of muzzle 44, or nozzle 50 may conveniently be a separate element fastened to muzzle 40, thereby permitting quick substitution of specialized nozzles for different applications. All such specialized nozzles are interchangeable for a particular model of water cannon 10. Referring to FIG. 3, nozzle 50 is attached to muzzle 44 by mating screw threads 51. In an alternative embodiment shown in FIG. 5, nozzle 50 includes a cylindrical rear portion 53, which slides into muzzle 44 where it may be fastened by welding, threads, or other conventional means.

In some embodiments, nozzle 50 may be articulated by: (1) rotating relative to the barrel 40; (2) removing the nozzle and replacing it with a nozzle of different orientation having a preferred orientation; or (3) rotating the entire water cannon relative to the heat exchanger mounting (this can also be done with a one piece barrel-nozzle embodiment) while nozzle 50 remains stationary relative to barrel 40.

As illustrated in FIG. 4, nozzle 50 may also be rotated automatically by a motor drive 64. Nozzle 50 is attached to barrel 40 with threads 81, which also allow rotation of the nozzle 50 by motor drive 64 through drive shaft 65, bevel gear 68, which meshes with ring gear 79, attached to the interior of nozzle 50 by welding. External controls (not shown) control signals to motor drive 64 and control the amount of rotation of nozzle 50.

Referring again to FIG. 4, nozzle 50 includes a nozzle extension 67 attached to the nozzle to direct the explosively discharged water down closer to the tube sheet 120. The extension configuration is advantageous in that energy is not dissipated in mixing with water in the heat exchanger and also in that the water in the heat exchanger may be lower than the opening in the heat exchanger wall through which the water cannon was inserted. In the latter case, the barrel 40 of the water cannon 10 may incorporate turning sections (not shown) so that the breech 42 of the water cannon 10 is below the water level in the heat exchanger. Alternatively, lateral nozzle extension 77 (shown in dotted lines in FIG. 4) can be fixed to muzzle 44 by conventional fasteners such as screw threads or swaging and nozzle 50, with or without nozzle extension 67, can be attached to muzzle 44, so that the nozzle and extension tube project farther into the tube lane.

An additional optional feature includes a series of vent holes 56 located in the top of the nozzle 50. The displacement of the gas 8 in the barrel 40 is assisted with small vent holes 56 in the top of the nozzle 50.

Figure 5:
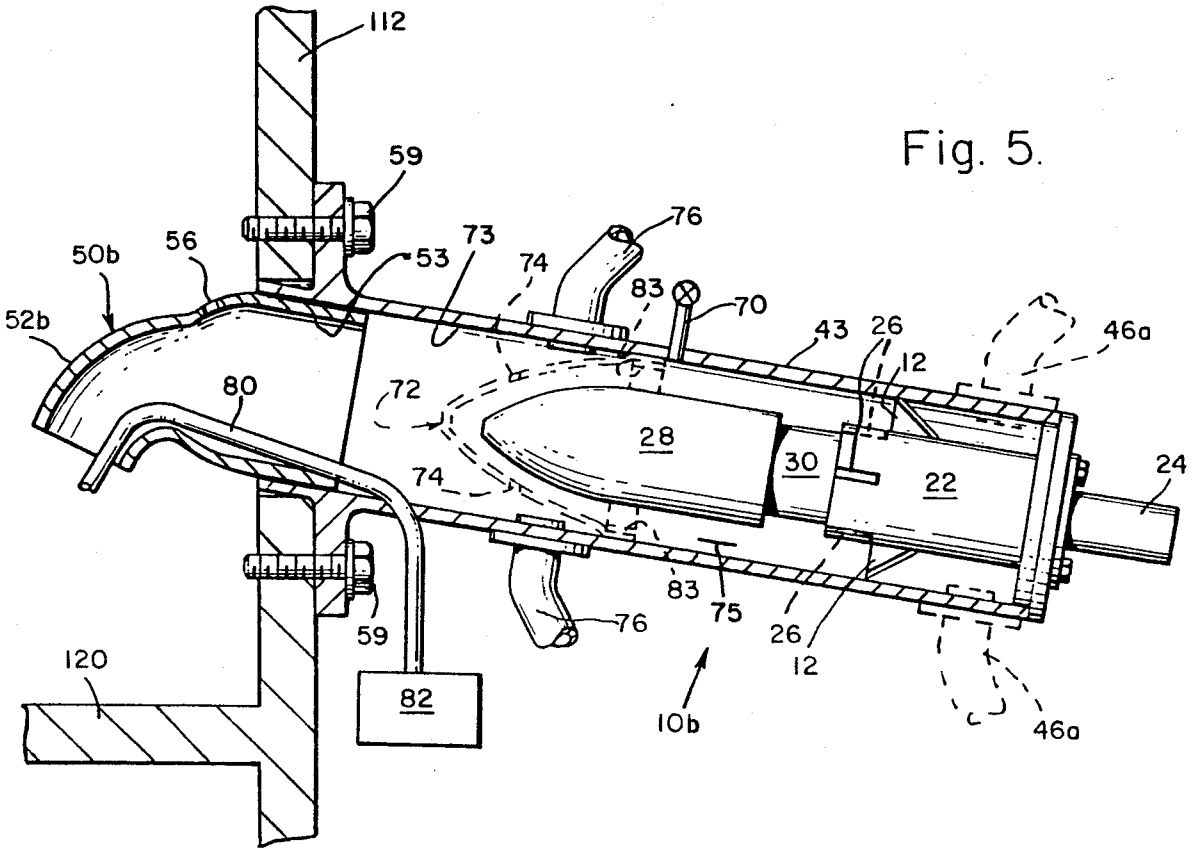
FIG. 5 is an elevation, partially in section, of another embodiment of a water cannon inserted in a penetration in a heat exchanger.

Referring to FIG. 5, one or more vent valves 70 are installed in the top 43 of barrel 40, for readily exhausting spent gas in the barrel 40. Vent 70 may be vented to the inside of the heat exchanger. Alternatively, vent 70 may be attached to the recirculation system through a venturi (not shown) to help exhaust the spent gas and water mixture from barrel 40 before the next firing. Also, vent 70 may be opened and closed automatically, so that vent 70 is closed during the explosive discharge of water cannon 10 pulses to quickly release gases. This automatically sequenced feature can also be incorporated into the holes 56 and any other openings in the barrel or breech. These vents should be placed at the highest portion of the barrel. Thus if the barrel slopes up from breech to nozzle as shown in FIG. 4, they should be at the breech. Alternatively if the breech of the barrel is elevated relative to the nozzle, the vents should be at the breech end to allow the gas to escape from the barrel.

Referring to FIG. 5, in a preferred embodiment, elastic membrane 72 is attached to the interior side wall 73 of barrel 40, substantially segregating the water and gas during discharge of water cannon 10*b*. When gas is explosively discharged by pressurized gas valve 22, elastic membrane 72, which may be rubber, or the like, and which is attached to interior side wall 73 by circumferential metal band 83, which is riveted or bolted to interior side wall 73, or other means, expands explosively toward muzzle 44, explosively discharging the load of water from muzzle 44. In this manner, elastic membrane 72 emulates the wadding of a shotgun shell, and reduces the energy lost through mixing of water and gas.

Elastic membrane 72 includes slits 74 through which gas flows slowly following discharge of water cannon 10*b*, and through which water flows slowly in and out of region 75 (the volume of barrel 40 between breech 42 and elastic membrane 72). When using the preferred embodiment having elastic membrane 72, it is preferable to use water inlets 76, near muzzle 44, to reduce reloading time. In addition, however, some water must be supplied to region 75 to replace the spent gas of firing, or reloading time will be too great. Accordingly, water inlets 46*a* supply the needed water. The volume of water supplied through water inlets 76 and the volume of water supplied through water inlets 46*a* are different, and will depend on the specific dimensions of a particular physical embodiment. Preferred flow rates can be readily determined by one skilled in the art.

Another option which may be added to water cannon lO*b* is a suction pipe or duct 80 which can be located immediately adjacent the exterior surface of the nozzle 50 or alternatively pass through the inside of the nozzle 50, as shown in FIG. 5. Suction pipe 80 is connected at its distal end to conventional suction apparatus 82, and removes the recirculation water, that is introduced into the steam generator through inlets 76 and nozzle 50. The method of using this optional feature will be described later on.

In another alternative embodiment of water cannon 10, the replenishment water nozzle(s) 46 are optional, since water will fill barrel 40 through nozzle 50 if nozzle 50 is below the water level in the heat exchanger and breech 42 is lower than muzzle 44, (as will be described).

Figure 10:
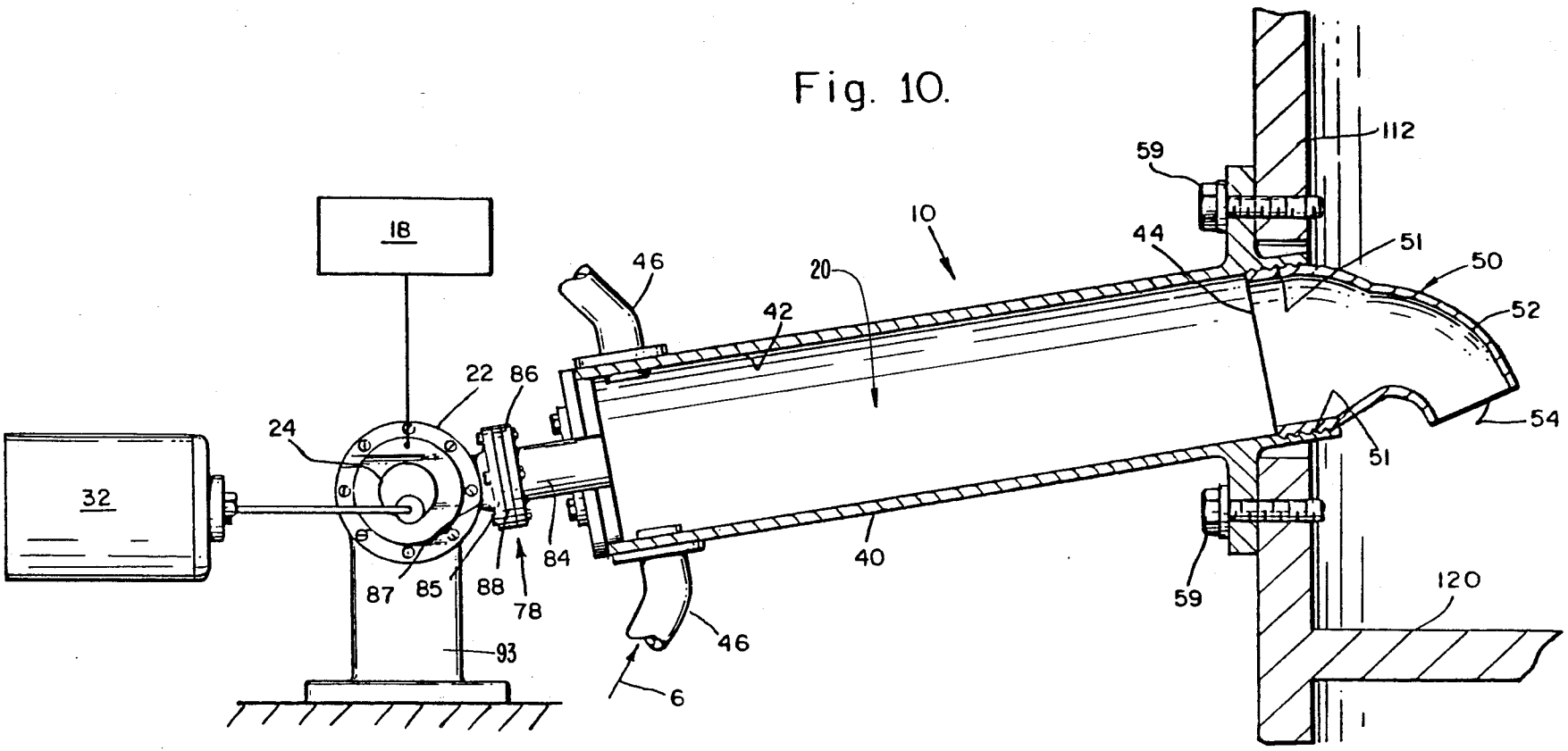
FIG. 10 is an elevation, partially in section, of a water cannon having the air gun located outside the barrel, shown with the barrel inserted into a heat exchanger with a gas source, solenoid and electronic circuitry shown in block diagram form.

Referring to FIG. 10, there is illustrated another preferred embodiment of water cannon 10 in which air gun 20 is located outside barrel 40. During firing, the explosive release of compressed gas is conducted from air gun 20 into breech 42 of water cannon 10 through manifold 78. Manifold 78 consists of ar gun manifold 87, welded to air gun 20, terminating in flange 85, and water cannon manifold 84, having one end welded to the back of breech 42, and likewise terminating in a flange 86.

To assemble the FIG. 10 embodiment of water cannon 10, a thick hard rubber gasket 88 is inserted between flanges 85, 86 to absorb the kick that results from firing water cannon 10 with only one gas exhaust port (not shown in FIG. 10) in air gun 20. Apertures in flanges 85, 86 are aligned and flanges 85, 86 are bolted together by four nuts and bolts.

It has been found that when air gun 20 is located outside barrel 40 of water cannon 10, these two elements of the apparatus must be as close together as practicable or efficiency of water cannon 10 will be unacceptably low. Accordingly, manifold 78 must be relatively short, on the order of only two to three inches. This does not permit air gun 20 to be located on the floor or other point far removed from breech 44 of barrel 40.

A suitable air gun 20 weighs about 100 pounds. In addition, when mounted with only one gas exhaust port, air gun 20 has a substantial kick. Manifold 78 must be sturdy enough to support not only the weight of the air gun, but to withstand its kick upon repeated firing, with or without optional mounting stand 93.

It has been found that this embodiment provides the, most versatile arrangement for actual use in the field because the same air gun can readily be removed from a water cannon of one size and immediately connected to a water cannon of a different size for a different job, thereby reducing the number of different sized units that must be held in inventory. In addition, if the air gun fails during a cleaning job, it can be replaced quickly, reducing expensive downtime. Finally, in the case of nuclear steam generator cleaning, it has the distinct advantage of maintaining a clean air gun, that is, one that is not contaminated with radiation, which greatly reduces all operating and maintenance costs.

The embodiment illustrated in FIG. 10 also fires a greater volume of water than other embodiments, since the volume that would have been displaced by the air gun inside the barrel is fully available for the water load, making it possible to substitute smaller barrels, which are easier to handle.

In all other respects, water cannon 10 as illustrated in FIG. 10 works the same as the other embodiments described herein. It is important to note that in any of the embodiments it does not matter whether the exhaust port or ports 26 of air gun 20 are exposed to water at any time during operation of the apparatus. The valves that control the explosive release of compressed gas from ports 26 open and close so quickly that water does not enter air gun 20. When air gun 20 is fired, naturally the compressed gas is explosively released, which pushes any water aside and prevents it from entering air gun 20. After firing, the valves close very quickly, before any water can enter air gun 20. Therefore, air gun 20 can actually be located inside barrel 40, as a preferred embodiment discloses. In the embodiment illustrated in FIG. 10, wherein air gun 20 is located outside barrel 40, and remote therefrom, it is not necessary for air gun 20 to be isolated from water that loads water cannon 10.

The following table provides empirical data (in the "nominal" column) and theoretically derived efficacious operating parameters.

Some Typical Water Cannon Parameters

| Parameter | Nominal | Range |
|---|---|---|
| Gas Pressure | 500 psi | 50 psi to 5000 psi |
| Gas Chamber Volume | 100 cubic in. | 10 to 1000 cu. inches |
| Valve Open Time (Pulse Duration) | 10 millisec | 1 millisec to 100 millisec |
| Blast Duration of Water | 100 millisec | 1 millisec to 1 Second |
| Repetition Interval | 5 Seconds | 0.1 sec to 100 sec |
| Barrel Diameter | 6 inches | 1 inch to 24 inches |
| Barrel Length | 24 inches | 6 in. to 144 inches |
| Nozzle Constriction Ratio | 4 | 1 to 40 |
| Nozzle Diameter | 3 inches | 1 inch to 10 inches |
| Replenishment Flow Rate | 100 gal/min | 1.0 to 1000 gal/min |
| Water Depth | 24 inches | 0 inches to full |
| Blast Water Exit Vel. | 150 ft/sec | 20 ft/sec-1000 ft/sec |
| Blast Flow Rate | 3000 gal/min | 100 to 30,000 gal/min |

The apparatus and its optional features have been described in considerable detail. The concept of the present invention is to use the water cannon, either in the simple preferred embodiment or using one or more of the optional features to "blast" the sludge 162 loose from its position on the tube sheet 120 and move it to a location where the sludge can be more easily removed from the steam generator, such as a sidewall. The concept of the present invention is to place at least one water cannon 10 through an existing opening in the heat exchanger wall 112 which is located in the general area of the tube sheet 120. A frequently used opening is a hand hole 114 as depicted in FIG. 1. The present invention is capable of working with a single water cannon 10 but can also be utilized with several Water Cannons 10 placed through several different hand holes 114. A hand hole 114 is typically located approximately twenty (20) inches above the Tube Sheet 120. Large openings through which a worker can crawl, known as manways, are also available for use with the present invention. Often, one or more of the hand holes 114 are located opposite an open lane 190 where one or more rows of tubes are not present. In this case, the water cannon 10 may blast directly down the tube lane 190.

Methods for cleaning the tube sheet of a heat exchanger utilizing the water cannon described herein will be discussed now. The operation of the water cannon 10 will first be described using the preferred embodiment and then the uses of the various alternative features will be discussed. As shown in FIG. 1, the at least one water cannon 10 is placed into a hand hole 114 located approximately twenty inches above the tube sheet 120. For purposes of this discussion, the water cannon 10 as described in FIG. 3 will be used. As shown in FIG. 1 and 3, the water cannon 10 is set at an angle to the horizontal such that the forward or muzzle end 44 of the barrel 40 is above the rear or breech end 42. Any angle of one degree or more is acceptable, but the preferred angle range is fifteen degrees to seventy-five degrees. It is also desirable to have breech 42 of the water cannon lower than the muzzle end 44 to facilitate the exit of the gas bubbles from the water cannon, and to allow some water to remain in the barrel between firings. This lowering the breech end of the cannon may facilitate lowering the water level in the heat exchanger so that the water stream impacts more directly upon the tube sheet.

First water cannon 10 is inserted into the heat exchanger through hand hole 114 in external shell 112 and secured thereto by bolts 59. Pressurized gas valve 22 is charged by feeding gas 8 from the gas source 32 through supply line 33, and into pressurized gas valve 22 and through conduit 30 into the gas accumulation chamber or gas storage plenum 28. In general, the gas accumulation chamber volume is preferably approximately 100 cubic inches, but ranges from approximately 10 to 1000 cubic inches are usable with the present invention. While the gas accumulation chamber 28 is being filled with pressurized gas 8, the barrel 40 is being filled with liquid such as water 6 through the at least one water inlet 46.

In a preferred embodiment, the barrel diameter is approximately six inches and the barrel length approximately twenty-four inches. Barrels may have a diameter ranging from approximately one inch to approximately twenty-four inches and a length in the range of approximately six inches to approximately twelve feet in accordance with the present invention.

When the preferred size of approximately six inches in diameter and twenty-four inches long for the barrel is used, the volume of water in the barrel 40 at the time of firing is approximately 2,700 cubic inches (or about 1.5 cubic feet), for a barrel of uniform diameter, prior to subtracting the volume of pressurized gas valve 22.

Either simultaneously or before the water cannon is so energized, heat exchanger 110 is filled with a liquid such as water 104 through inlet passages 140 and 142 until the level of water 104 is above the level of muzzle 44. In this method, the covering water on the tube sheet becomes a cleaning medium itself, as it is stirred and agitated by the water blast from the nozzle 50.

The electronic circuitry 18 is then triggered to activate the solenoid 24, which in turn causes the solenoid activated pressurized gas valve 22 to fire, causing the gas to discharge from the gas accumulation chamber 28 through the interconnecting passageway 30 and into the gas valve member 22 and out the ports 26 of the gas valve member 22 into the barrel 40. In the preferred embodiment, the gas 8 in the accumulation chamber is initially at approximately 500 pounds per square inch pressure. Ranges of initial pressure for the gas 8 from fifty pounds per square inch to five thousand pounds per square inch are usable with the present invention. In the preferred embodiment, the pressurized gas valve open time or pulse duration for gas discharge is approximately ten milliseconds but pulse durations ranging from approximately one millisecond to approximately one-hundred milliseconds are usable with the present invention.

The abrupt discharge of gas 8 under pressure creates a transient pressure force on the water 6 in the barrel 40. The flow velocity and impact of the water traveling from the barrel 40 to the nozzle and then out of the nozzle 50 is enhanced by the decrease in exit diameter of the nozzle versus the diameter of the barrel. In the preferred embodiment, the nozzle constriction ratio from its diameter at the location of the muzzle 44 of the barrel 40 to its exit location 54 is four to one. A range of constriction ratios from one to one (no constriction) to forty to one is usable with the present invention. In a preferred embodiment, the diameter of the nozzle at its exit 54 is approximately three inches. Terminal nozzle diameters of approximately one inch to approximately ten inches are usable with the present invention.

In the preferred embodiment, the duration of the blast of water is approximately one hundred milliseconds. Water blast duration ranges from approximately ten milliseconds to one second are usable with the present invention. The water blast flow rate of water leaving the nozzle 50 and entering the heat exchanger 110 is preferably about three thousand gallons per minute. Water blast flow rates ranging from approximately one hundred to thirty thousand gallons per minute are acceptable for the present invention. In the preferred embodiment, the water exit velocity from the nozzle 50 is approximately one hundred and fifty feet per second. Water exit velocity ranges from ten feet per second to one thousand feet per second are usable with the present invention.

Figure 6:
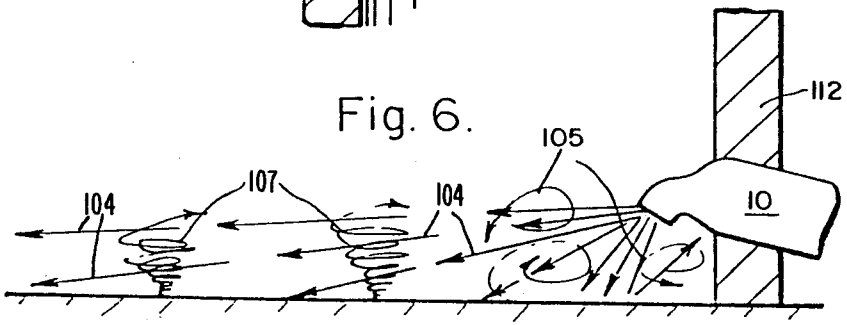
FIG. 6 is a schematic elevation, partially in section, of turbulence such as ring vortices and water tornadoes created in the liquid medium of the heat exchanger by the blast from the water cannon.

The explosive blast of water from the nozzle has a very potent impact on both the loose sludge 162 sitting at the uppermost portion of the sludge pile 160 and the more encrusted sludge at the lower levels of the sludge pile, which sit directly on the tube sheet 120 and adhere to the lower portions of the heat exchanger tubes 132 that are surrounded by the sludge pile 160. As shown in the schematic perspective view of FIG. 6, the blast of water 6 into the heat exchanger causes vigorous turbulence in water 104 inside the heat exchanger. Ring vortices 105 and tornado-like swirls 107 are created in water 104 and these disturbances enhance the cleaning action of the blast. As shown in FIG. 7, the blast of water 6 from the water cannon 10 agitates, loosens and moves the sludge toward the location of the heat exchanger remote from the water cannon 10. In addition, the water blast suspends some of the loosened sludge in the water.

Several alternative embodiments for removing the sludge from the heat exchanger after shooting it with the water cannon to loosen it are incorporated with the present invention. The first method is shown in FIG. 1 and is usable in heat exchangers where there are at least two hand holes 114, one through which the water cannon 10 is placed and the second through which a suction nozzle 90 is inserted. In the preferred embodiment of this system, the suction nozzle 90 is located at approximately the opposite side of the heat exchanger 110 from the water cannon nozzle 50. The suction nozzle 90 sucks the water 104 and 6 out of the heat exchanger, thereby removing the sludge which has been loosened, some of which is suspended in the water being removed and some of which is loose and has been blasted to a location adjacent to the suction nozzle. The suction nozzle 90 is connected to a pump 92 which serves to move the water (104 and 6) from the suction nozzle to a filtering system 94. The filtering system 94 removes the entrained and suspended sludge from the water and thereafter recirculates the water back into the water cannon through the at least one inlet nozzle 46. It is important to have this debris removed from the water before it is recirculated back into the water cannon 10 since the particles suspended in the water fired from water cannon 10 may damage heat exchanger tubes with which they come in contact.

Before the cycle is repeated, the water cannon 10 is once again filled with water 104. In the preferred embodiment, the heat exchanger 110 is partially filled with water 104. Since the hand hole 114 is usually approximately twenty inches above the tube sheet 120, the preferred water level is approximately twenty-four inches so that the water level is above the water cannon 10. The level of the water 104 may be increased if it is desired to obtain more back pressure on the water cannon or to simultaneously clean upper portions of the heat exchanger. Alternatively, the water level may be lowered to concentrate the cleaning action on the tube sheet. The range of water levels can be anywhere from zero (i.e. with the heat exchanger empty) to a completely full heat exchanger with water extending all the way to the top of the heat exchanger. It is important that water cannon 10 is loaded with water before it is fired.

When the water level in the heat exchanger is near zero, the water blast from the cannon hits the tube sheet and spreads into a thin high velocity sheet of water which carries the loose debris and sludge particles to the perimeter of the tube bundle. One way of facilitating the further removal of the sludge from the perimeter of the tube bundle is to use a "peripheral flow" system such as described in U.S. Pat. No. 4,079,701. The peripheral flow system may be used simultaneously, after, or alternatively with the water cannon and may utilize the water inlets 140 and 142 and suction discharges 90 of the present invention.

An alternative method of using the Water Cannon embodiments of the present invention is shown in FIG. 8. Instead of a full recirculation system, fresh water 6 is provided to the water cannon 10 by a water source 200 and when the water 104 and 6 is vacuumed out of the heat exchanger 110, the water is emptied into a drain 210 and not recirculated back into the heat exchanger.

Another alternative method of using the water cannon is shown in FIG. 9. The method of FIG. 9 is used most frequently in heat exchanger design which contain only one hand hole 114 or other opening such as a manway adjacent to the tube sheet 120. In such designs, the simple water cannon must be used to continuously shoot blasts of the same water into the heat exchanger. The water cannon is fired as previously described. As shown in FIG. 9, the water level inside the heat exchanger is substantially above the water cannon 10 and the water cannon is also tilted at a substantial angle to the horizontal with the breech 42 of the barrel 40 located well below the muzzle end 44. The result is that after the firing, the water cannon automatically fills with water from the heat exchanger and after the air gun is once again pressurized, it is fired and the water once again forced out. This method may not be as satisfactory as methods utilizing fresh water for loading the water cannon, since loosened sludge will also be sucked into the heat exchanger. Since the water 6 is shot out of the water cannon under high pressure and high velocity, there is some risk of the sludge acting like a projectile and damaging the heat exchanger tubes. Alternatively, a vacuum suction tube 80 shown in FIG. 5 can be attached to the water cannon, so that the water inlet and water suction for the recirculation systems may take place through the same hand hole. Two of these water cannons may then be used in two hand holes.

It is preferable to have rapid replenishment of the water cannon 10. The preferred replenishment flow rate of water into the water cannon 10 is approximately 100 gallons per minute, but ranges from 1.0 gallon per minute to 1000 gallons per minute are usable with the present invention. Rapid refiring of the water cannon 10 is also preferred to further loosen sludge which was only partially loosened in the previous firings, and to keep loosened sludge particles in suspension. The preferred firing repetition interval is approximately once every five seconds, but repetition firing intervals from approximately 0.1 second to approximately 100 seconds is within the spirit and scope of the present invention.

Although the simple water cannon has been described as the preferred embodiment, one or more of the embellishments can be added to enhance the effectiveness of the water cannon. In its most basic form, the water cannon comprises a barrel have a breech and muzzle end, at least one water inlet for enabling water to enter the barrel, a pressurized gas valve assembly which must be capable of opening and closing quickly to release a charge of pressurized gas into the barrel and which may be located inside the barrel, and a nozzle member for increasing the flow velocity and directing the flow down onto the surface to be cleaned. The pressurized gas valve is connected to a source of gas and is further connected to a chamber which permits the gas to accumulate before it is fired. The pressurized gas valve is also connected to valve triggering means such as the solenoid and electronic firing circuitry as previously described. The water cannon is inserted into a penetration in the heat exchanger such as a hand hole, such that the nozzle at least partially protrudes through the penetration. The barrel is aligned at an angle below the horizontal. Although the heat exchanger can have water inside it at any level, from being completely empty to completely full, in the preferred embodiment, the water level is a few inches above the uppermost level of the water cannon. The pressurized gas source is activated to discharge a blast of pressurized gas into the barrel which in turn forces the water in the barrel out under pressure, through the nozzle and into the heat exchanger. In the preferred embodiment, the nozzle is oriented to that the blast of water is directed down onto the tube sheet such that the water cannon motion acts on the pile of sludge to loosen it and to move at least some of the loosened sludge to an area of the heat exchanger where it can be removed by vacuuming and filtering.

As discussed, several optional features can be added to the water cannon to enhance its effectiveness. A horizontal extension member can be added to the nozzle. An extension can be positioned directly within the tube lane, directing the nozzle toward the center of heat exchanger and along the tube lane adjacent to the two kidney shaped areas (previously described) where most of the sludge tends to settle. The result is a more direct hit from the blast of water which enhances the effectiveness of the blast. With a vertical extension, the level of water in the heat exchanger can be lower than the level of the water cannon. Such an extension can extend both vertically and horizontally.

Several optional features can be located inside the barrel to enhance the flow of pressurized gas to increase the blast or to improve the gas and water movement to enhance the blast. One or more of the following can be used in various combinations. The water cannon may include one or more deflector members as previously described which serve to direct the gas exiting the valve ports of the pressurized gas valve assembly down the barrel and toward the water in the barrel waiting to be impacted. The deflector vanes may in turn include slots to permit the water to flow around and/or through the vanes. One or more mixing vanes may be located adjacent the inner wall of the barrel. The mixing vanes serve a dual purpose: (a) they assist in transferring energy from the gas to the water and (b) they serve to prevent gas from hugging the side walls of the barrel and going directly out of the nozzle without impacting the water in the barrel.

The nozzle may further incorporate swirl vanes which serve to add vorticity to the water as it is shot out of the barrel. The swirl vanes can be located in the nozzle adjacent to muzzle end of the barrel, as shown in FIG. 4 or alternatively the swirl vanes may be located at the forward end of the muzzle of the barrel. The swirl vanes help to spread the water blast and further assist in the creation of ring vortices and tornado like disturbances which serve to help agitate, loosen and move the sludge.

The water cannon may contain one or more of several alternative features to assist in the removal of fired gas form the barrel before the subsequent pressurized gas valve refiring. One such element is at least one vent hole in the top of the nozzle to assist in fired gas removal. A second such feature is at least one vent valve in the top of the barrel.

The Nozzle may contain several alternative features such as the extension tube previously described. The nozzle may also include one or more types of articulation means by which the direction of the nozzle discharge may be varied. The nozzle may be a separate section attached to the barrel and capable of movement relative to the barrel. Through the articulation device previously described, the nozzle can be rotated form side to side, up and down, or in an arcuate path to direct the water blast. In this way, after the water cannon has been fired for a period of time, the direction of the blast can be modified to direct the blast to areas which have not been fully cleaned.

The effect of the gas discharge can also be enhanced with the optional rubber bag or elastic membrane, which effectively creates a plenum enveloping the forward portion of the pressurized gas valve. As discussed, the plenum then serves to accumulate gas in the barrel to thereby create a larger piston effect in pushing the water out of the barrel. The plenum, in turn, may include some penetrations to allow the slow of gas and water out of the plenum region. With this addition, the at least one primary water inlet should be located forward of the plenum but at least one secondary water inlet should be located aft of the plenum to replenish water lost in that area of the barrel.

All of the options described above can be used with any of the water replenishment and recirculation systems previously described. A preferred vacuuming, filtering and recirculation system is disclosed in FIG. 1. In this embodiment, it is preferable to have at least two openings adjacent the area to be cleaned, such as the tube sheet. The water cannon is inserted through one opening as previously described. A suction nozzle is inserted through the second opening. The sludge is blasted to a location adjacent the suction nozzle, which then removes the sludge through a conventional vacuuming process. Water moving means, such as a pump, moves the sludge from the suction nozzle to a filter. Any one or more filtering methods such as a mechanical filter, a centrifugal filter, and ion exchanger apparatus, a settling tank, a strainer, or a magnetic filter can be used to filter the water. The filtered water is then recirculated back into the water cannon for a subsequent refiring. Alternatively, a suction means can be added directly adjacent the water cannon, either just outside the water cannon shell or just inside the water cannon shell. If the recirculation nozzle is incorporated in the water cannon in this manner, a water cannon may be placed in each available hand hole.

Alternatively, the filtering operation can be dispensed with and the open loop systems may be used, if it is desired to simply have a continuous supply of fresh water pumped into the water cannon before each firing and to have the water sucked out of the heat exchanger through the suction nozzle and emptied down a drain during or after the cannon operation.

Alternatively, in the simplest embodiment, a gravity fill system may be utilized wherein the water cannon is set at an angle below the horizontal and the level of water in the heat exchanger is above the water cannon. After each firing, gravity and back pressure from the high water level in the water cannon force water back into the water cannon, from which it can be shot out on the next refiring.

The present invention also involves a method for cleaning sludge and debris from the bottom of a tube bundle heat exchanger using a high velocity, high mass flow rate water stream operating with repetitive blasts of water into a partially water filled suitable apparatus to be used with this method, as has previously been described.

The method involves the following steps:

1. Obtaining water cannon apparatus with the following capabilities:

a. Directing a high velocity, high mass flow rate blast of water through a penetration of the shell of a tube bundle heat exchanger down onto the heat exchanger tube sheet.

b. Providing nozzle exit velocities in the range of 10 to 1000 feet per second and mass flow rates in the range of 100 to 30,000 gallons per minute.

c. Providing repetitive blasts each of duration 0.001 to 1 second and with repetition intervals in the range of 0.1 to 100 seconds. Typically the duty cycle, which is the ratio of blast duration to repetition interval, is in the range 0.001 to 0.1.

2. Draining the heat exchanger to a level down below the hand hole, manway, or other penetration in the shell to be used to connect the water cannon to the interior of the heat exchanger (this is an optional step).

3. Attaching the water cannon to the heat exchanger via the penetration and connecting all of the necessary gas pressure lines, electrical firing lines, and water replenishment lines to the water cannon. The penetration will preferably be located in front of the tube lane 190 so that the nozzle tends to shoot down the lane and into the tube bundle interior.

4. In the preferred embodiment a recirculation system is connected to the heat exchanger consisting of: (1) an inlet nozzle which may be the replenishment nozzle in the water cannon barrel 40 or may be introduced separately into the heat exchanger; (2) a suction nozzle 90 which should preferably be located in the opposite side of the heat exchanger away from the water cannon nozzle; and (3) a pump and filter system for removal of the entrained and suspended debris extracted from the water in the tube bundle heat exchanger and from the water shot out of the water cannon, and reintroducing the water into the water cannon. It is very important to remove any large pieces of debris by filtering or separating before the water is re-introduced into the water cannon in order to avoid damaging the heat exchanger tubing due to impact.

5. In the preferred embodiment, the heat exchanger is filled partially with water. If the level of the penetration through which the water cannon is inserted in the heat exchanger shell is 20 inches above the tube sheet, a typical water level is 24 inches above the tube sheet. The level may be increased if it is desired to obtain more back pressure on the water cannon or to simultaneously clean upper portions of the heat exchanger. Alternatively, the water level may be lowered to concentrate the cleaning action on the tube sheet. Care must be take to insure that the water cannon configuration, recirculation system, and water level are such as to insure that the barrel of the water cannon is refilled with water before the water cannon is fired.

6. Activating the recirculation and filtering system which may include a water replenishment nozzle on the water cannon. Any one of the previously described water replenishment and suction removal systems may be used.

7. Firing the water cannon to generate a blast of high velocity, high flow rate water down onto the bottom of the tube sheet. The pressure used in the water cannon should be in the range of 50 to 5000 psi. The comprehensive volume of gas released should be in the range of 10 to 1000 cubic inches. The valve opening time should be in the range of 1 to 100 milliseconds. Of course the valve opening time may be longer if a plenum is used to limit the volume of gas released. The blast of water will create a high velocity sheet of water (FIG. 4) moving laterally across the tube sheet to loosen, entrain, and suspend sludge and debris and to move the debris toward the suction nozzle and to the periphery of the tube bundle where it may be removed from the heat exchanger. If there is water in the heat exchanger when the water cannon is fired, the water stream will generate a "ring vortex" created by the shear between the blast stream and the ambient water. This vortex will propagate through the tube bundle and across the tube sheet causing a cleaning action which pushes and suspends the sludge. In addition, the negative pressure in the vortex is particularly effective in lifting the loose sludge up into suspension from the bottom of the heat exchanger. If swirl has been added to the water blast stream through swirl vanes in the water cannon, the stream will spread more rapidly causing a vortex of larger filament diameter. Also, the swirl will create tornado type vortices which will dance across the tube sheet pulling up fine sludge particles into the core lower pressure area. This ring vortex and tornados will tend to break up into smaller vortices when they encounter the tubes but these small vortices will also help clean the tube sheet.

8. Repetitively firing the water cannon at a repetition rate of between 0.1 and 100 seconds to continue the tube sheet cleaning process and to keep the fine sludge material with diameters between near 0 and 50 microns in suspension. Each time the water cannon is fired the large sludge particles with diameters larger than about 50 microns, move a little distance across the tube sheet toward the suction nozzle and toward the periphery of the tube bundle where they may be removed by the suction nozzle or by a separate peripheral flow system. (See for example, Westinghouse Pat. No. 4,079,701). The repetition rate should be as rapid as possible within the constraints of the time it takes to recharge the pressurized gas chamber and to refill the cannon barrel with water. The repetitive firing should be continued for approximately 1 minute to 24 hours until the tube sheet is clean.

9. The nozzle may be articulated to direct the flow of water to different locations on the tube sheet.

10. Draining the steam generator to a level below the hand-hole and removing the water cannon, the suction nozzle, and recirculation equipment after the cleaning has been completed.

Up to this point, the method has been described with the intention of cleaning the tube sheet. While the primary thrust of the present invention is to clean a heat exchanger tube sheet, the present invention also has some application in cleaning heat exchanger upper tube support plates. When directing the apparatus of the present invention to cleaning upper tube support plates, it may be desirable to vary the water level continuously or in increments during the cleaning process. The water level may start low and clean submerged surfaces while filling. The nozzle (and any extensions thereto if applicable) is directed toward the tube support plate to be cleaned and the water cannon is then fired and refired as previously described. Preferably, the upper tube support plate will be cleaned first and then the water level will be lowered, either incrementally after each support plate cleaning or continuously during the blasting process. It is recognized that most of the effect on the highest tube support plates will be blocked by lower tube support plates and that tube supports plates above the second level will only be marginally cleaned. The water level may then be lowered to bring the suspended debris to the bottom of the tube sheet where it may be removed from the heat exchanger. Finally, the water may be drained from the unit and the water cannon operated with a peripheral flow system and scavenger pump to remove the remaining debris from the tube sheet. The water level may be changed during the repetitive firing by adding or removing water from the heat exchanger. Alternatively the water cannon may be shut off while the water level is changed.

It is also possible to simultaneously clean more than one heat exchanger with the present invention. In this alternative cleaning method, separate Water Cannons are placed in each of two (or more) heat exchangers. Illustrating to process with only two heat exchangers, "a" and "b", heat exchanger "b" can be filled with the same water that is being drained from heat exchanger "a" while the cleaning procedure is being performed in both generators simultaneously. This "leap frog" procedure can be used for all generators being cleaned, saving water and time.

In addition to cleaning the tube sheet of a nuclear or other steam generator, the present inventive methods and apparatus will effectively clean support plates, internals and the tube bundles themselves. In smaller heat exchanges, the tube bundle may be removed from the shell and water cannon 10 can be mounted on a supporting structure independent of the shell (not shown) and the discharged water directed at the tube bundle or other internals to clean them.

Although the detailed description of the preferred embodiment has been largely devoted to use of the apparatus and method of the present invention in a steam generator or other heat exchange, valuable applications can be found in many other contexts. A water cannon according to the present invention may also be used to clean any durable surface that requires cleaning according to the methods disclosed herein. For example, the present invention may be used to remove graffiti from buildings, sidewalks, exterior walls, and so forth. It may also be used to remove paint or plaster from swimming pools in preparation for refinishing. It may also be used to remove barnacles from ships, piers, docks, and so forth. In some applications, the present invention can be used in lieu of sandblasting. In this application, the present invention has the distinct advantage of reducing the clean-up required after the cleaning is complete. In short, the present invention may be used to clean any hard durable surface to which some build-up of stubborn debris or stains adhere.

Of course the present invention is not intended to be restricted to any particular form or arrangement, or any specific embodiment disclosed herein, or any specific use, since the same may be modified in various particulars or relations without departing form the spirit or scope of the claimed invention herein above shown and described of which the apparatus and method shown is intended only for illustration and for disclosure of an operative embodiment and not to show all of the various forms of modification in which the invention might be embodied.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. A water cannon comprising:

a. a barrel having a breech and a muzzle;

b. an air gun inside said breech;

c. said air gun further comprising, (i) a plenum for storing pressurized gas, (ii) a gas valve, (iii) at least one port in the gas valve, (iv) means for connecting the gas valve and the plenum, the connecting means also permitting communication of gas between the gas valve and the plenum, (v) a source of pressurized gas operatively connected to the gas valve; and d. at least one deflector disposed about said gas valve adjacent to the at least one gas port and between said breech and the at least one gas port, for deflecting the gas released from the at least one gas port toward said muzzle.

2. A water cannon in accordance with claim 1 further comprising a nozzle attached to said muzzle.

3. A water cannon in accordance with claim 2 wherein said nozzle further comprises a directional nozzle.

4. A water cannon in accordance with claim 1 wherein said air gun further comprises means for firing said air gun.

5. A water cannon in accordance with claim 1 further comprising at least one water inlet adjacent to said breech and communicating with the interior of said barrel.

6. A water cannon in accordance with claim 1 further comprising at least one water inlet adjacent to said nuzzle and communicating with the interior of said barrel.

7. A water cannon in accordance with claim 1 further comprising means for directing explosively released gas through said barrel along the central axis of said barrel.

8. A water cannon in accordance with claim 7 wherein said directing means further comprises a plurality of swirl vanes fixed to the inside of said barrel at a point intermediate said muzzle and said breech.

9. A water cannon in accordance with claim 1 further comprising a plurality of swirl vanes fixed inside said barrel adjacent to said muzzle.

10. A water cannon in accordance with claim 9 wherein said swirl vanes further comprise a plurality of turbine blades disposed perpendicular to the longitudinal axis of said barrel.

11. A water cannon in accordance with claim 1 further comprising an extension member fixed to said muzzle for permitting adjustment of the length of said muzzle, said extension member having a muzzle-end.

12. A water cannon in accordance with claim 11 further comprising a nozzle fixed to the muzzle-end of said extension member.

13. A water cannon in accordance with claim 1 further comprising at least one vent valve attached to said barrel and communicating therewith, disposed intermediate said muzzle and said breech.

14. A water cannon in accordance with claim 1 further comprising a plurality of vent holes through said barrel adjacent to said breech.

15. A water cannon in accordance with claim 1 further comprising means for removably attaching said water cannon to the exterior side wall of a heat exchanger.

16. A water cannon in accordance with claim 1 further comprising an elastic membrane attached to the circumferential interior side wall of said barrel intermediate said air gun and said muzzle, and disposed transverse to said barrel.

17. A water cannon in accordance with claim 1 further comprising a suction hose disposed in a port in said barrel adjacent to said muzzle.

18. A water cannon comprising:

a. a barrel having a breech and a muzzle;

b. an air gun inside said breech;

c. an extension member fixed to said muzzle for permitting adjustment of the length of said muzzle, said extension member having a muzzle-end;
d. a nozzle fixed to the muzzle-end of said extension member; and
e. a suction hose disposed in a port in said nozzle intermediate the ends of said nozzle.

19. A water cannon in accordance with claim 18, further comprising a nozzle extension fixed to said nozzle.

20. A water cannon comprising:
a. a barrel having a breech and a muzzle;
b. an air gun inside said breech;
c. an extension member fixed to said muzzle for permitting adjustment of the length of said muzzle, said extension member having a muzzle-end;
d. a nozzle fixed to the muzzle-end of said extension member; and
e. a nozzle extension affixed to said nozzle; and
f. said nozzle includes a plurality of vent holes in the upper forward portion of said nozzle.

21. A water cannon comprising:
a. a barrel having a breech and a muzzle;
b. an air gun inside said breech; and
c. an elastic membrane attached to the circumferential interior side wall of said barrel intermediate said air gun and said muzzle, and disposed transverse to said barrel.

22. A water cannon comprising:
a. a barrel having a breech and a muzzle;
b. an air gun inside said breech; and
c. a suction hose disposed in a port in said barrel adjacent to said muzzle.

23. A water cannon comprising:
a. a barrel having a breech and a muzzle;
b. an air gun inside said breech;
c. said air gun further at least comprising,
(i) a gas valve,
(ii) at least one port in the gas valve,
d. a nozzle attached to said muzzle;
e. at least one water inlet adjacent to said breech and communicating with the interior of said barrel attached to said breech for loading said water cannon with water; and
f. at least one deflector disposed about said gas valve adjacent to the at least one gas port and between said breech and the at least one gas port, for deflecting the gas released from the at least one gas port toward said muzzle.

24. A water cannon in accordance with claim 23 wherein said nozzle further comprises a directional nozzle.

25. A water cannon in accordance with claim 23 further comprising means for directing explosively released gas through said barrel along the central axis of said barrel.

26. A water cannon in accordance with claim 25 wherein said directing means further comprises a plurality of swirl vanes fixed to the inside of said barrel at a point intermediate said muzzle and said breech.

27. A water cannon in accordance with claim 23 further comprising a plurality of swirl vanes fixed inside said barrel adjacent to said muzzle, said swirl vanes being disposed perpendicular to the longitudinal axis of said barrel.

* * * * *